US007147516B1

(12) United States Patent
Yen

(10) Patent No.: US 7,147,516 B1
(45) Date of Patent: Dec. 12, 2006

(54) SELF-CLEANING TERMINAL MATCHING ASSEMBLY

(75) Inventor: Ming Hui Yen, Taipei Hsien (TW)

(73) Assignee: Chant Sincere Co., Ltd., Taipei Hsien (TW)

( * ) Notice: Subject to any disclaimer, the term of this patent is extended or adjusted under 35 U.S.C. 154(b) by 0 days.

(21) Appl. No.: 11/272,674

(22) Filed: Nov. 15, 2005

(51) Int. Cl.
*H01R 24/00* (2006.01)

(52) U.S. Cl. ..... 439/630

(58) Field of Classification Search ..... 439/630, 439/188, 157, 159, 160
See application file for complete search history.

(56) References Cited

U.S. PATENT DOCUMENTS 2,283,498 A * 5/1942 Glennon ..... 439/688
2,372,882 A * 4/1945 Daly et al. ..... 200/46
2,486,285 A * 10/1949 Hurst ..... 439/843
4,069,403 A * 1/1978 Beaudette et al. ..... 200/51.12
4,438,303 A * 3/1984 Astier ..... 200/51.1
4,472,016 A * 9/1984 Rodseth ..... 439/856
4,634,210 A * 1/1987 Crawford ..... 439/630
5,533,907 A * 7/1996 Kozel et al. ..... 439/188
6,719,589 B1 * 4/2004 Nishio et al. ..... 439/630
6,890,195 B1 * 5/2005 Nagata ..... 439/159

* cited by examiner

*Primary Examiner*—Tulsidas C. Patel
*Assistant Examiner*—Vladimir Imas
(74) *Attorney, Agent, or Firm*—Bacon & Thomas, PLLC

(57) ABSTRACT

A self-cleaning terminal matching assembly has a plurality of terminals to match with correspondingly inclined surfaces and cambered arcs so that at least one active terminal and at least one passive terminal are in contact with one another in a self-cleaning manner and the terminals maintain a good contact state. The position for matching the terminals is dependent on the form and kind of each terminal and is not limited. It is preferred that the rigidity strength of the passive terminal is greater than that of the active terminal.

8 Claims, 6 Drawing Sheets

SELF-CLEANING TERMINAL MATCHING ASSEMBLY

BACKGROUND

1. Field of the Invention

The present invention relates to self-cleaning terminal matching assemblies, and in particular to a terminal matching assembly having a plurality of terminals to match respective inclined surfaces and cambered arcs so that at least one active terminal and at least one passive terminal contact one another in a self-cleaning manner.

2. Description of the Prior Art

Various terminals of the prior art contact each other by compressing and coupling with one another so as to assemble the terminals together. Thereby an active terminal is in contact with a passive terminal by pressing the terminals together. This is convenient in current or signal conduction and transfer. A conduction contact of the terminals may take alternative forms, including a plane surface connecting to a plane surface, an elastic contact connecting to a plane surface, or an elastic contact connecting to an elastic contact. However, it is difficult to avoid that the terminal gets metal oxidization or the contact surface of the terminal accumulates with dust, dirt or oil after long time use. Thus, the contact position of the terminal is not able to always keep a state of cleanliness therefore causing bad communication between the matching conduction terminals and furthermore causing bad conduction of current or signal transfer.

FIGS. 15 and 16 illustrate the assembly of a memory card insertion seat 10, a card reader and various detection terminal sheet sheets 20, 30 and 40 of the prior art. When the memory card is inserted into the memory card insertion seat, the memory card forces the contacts 20*a*, 30*a* of the two detection terminal sheets 20, 30 (e.g. active terminals) and the contact 40*a* of the detection terminal sheet 40 (e.g. passive terminal) to contact each other. The matching terminals are in contact with one another by the contact of plane surfaces so that the contacts 20*a*, 30*a* and 40*a* of the terminal are oxidized or dust easily accumulates to cause bad conduction of current or signal transfer of the terminals.

SUMMARY

Accordingly, a primary object is to provide a self-cleaning terminal matching assembly. The assembly has a plurality of terminals which match one another by the contact of the inclined surfaces and cambered arcs thereof, so that at least one active terminal and at least one passive terminal are in contact with one another to have the function of self-cleaning during the frictional engagement of the terminals. During the frictional engagement, metal oxide, dust, and dirt at the contact surfaces of the terminals can be removed such that the effect of the frictional engagement provides self-cleaning. Thus the terminals contact each other so as to have preferred conduction and communication states for a longer time.

A secondary object is to provide the self-cleaning terminal matching assembly and the position for matching the terminals that is dependent on the form and kind of each terminal. Also the form and kind of each terminal is not limited. Further, the assembly has at least one active terminal and at least one passive terminal matched to the active terminal so that the various matching terminals have the function of self-cleaning during the frictional engagement of the terminals.

Another object is to provide a self-cleaning terminal matching assembly, and it is preferred that the rigidity strength of the passive terminal is greater than that of the active terminal so that the elasticity of the active terminal is greater than that of the passive terminal. Thereby when the active terminal is pressed to contact the passive terminal, a dramatic friction force is induced so as to have the effect of removing undesired objects of the contact surfaces and thus has the function of self-cleaning.

The various objects and advantages will be more readily understood from the following detailed description when read in conjunction with the appended drawings.

DETAILED DESCRIPTION

In order that those skilled in the art can further understand the present embodiments, a description of each embodiment will be provided. However, these descriptions and the appended drawings are only used to cause those skilled in the art to understand the objects, features, and characteristics of the embodiments, but are not to be used to confine the scope and spirit of the present invention defined in the appended claims.

Figure 1:
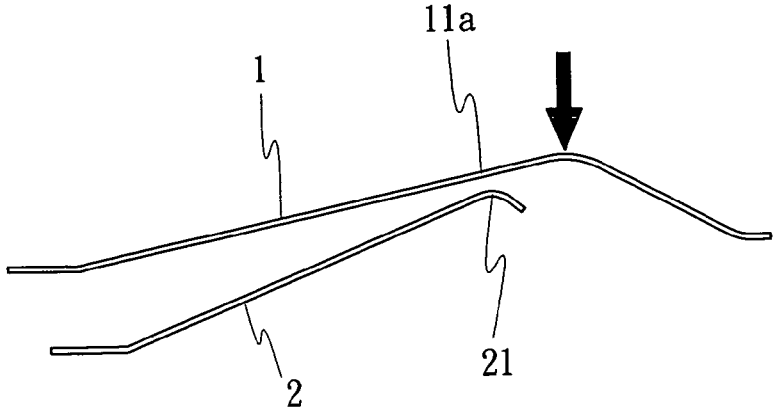
FIG. 1 is a perspective view showing that the active terminal contacts the passive terminal by compressing the passive terminal in the same direction at the bottom rear surface of the active terminal of this embodiment.
Figure 2:
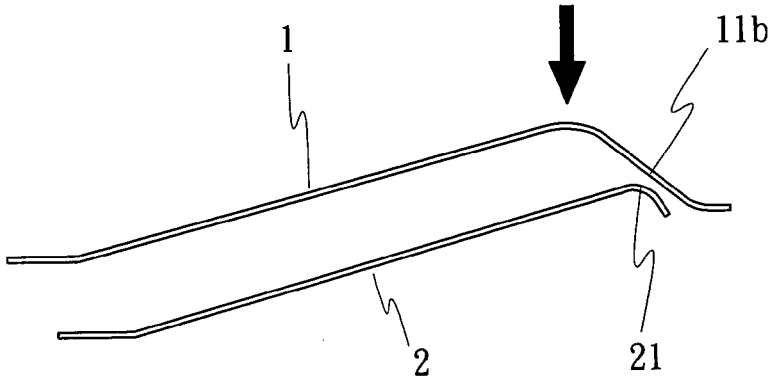
FIG. 2 is a perspective view showing that the active terminal contacts the passive terminal by compressing the passive terminal in the same direction at the bottom front surface of the active terminal of this embodiment.

Referring to FIGS. 1 and 2, the self-cleaning terminal matching assembly is illustrated. The assembly has at least one active terminal 1 and at least one passive terminal 2 matched to the active terminal 1. The form and kind of each terminal (including the active terminal 1 and the passive terminal 2) is not limited. The active terminal has an inclined surface 11*a* (or 11*b*) and the passive terminal has a cambered arc 21 matching to the inclined surface. Thereby, when the active terminal 1 and the passive terminal 2 are compressed downwards, the inclined surface 11*a* (or 11*b*) and the arc 21 are rubbed by one another. Thereby the friction due to the rubbing has the function of self-cleaning the terminals. Thus, the terminals 1 and 2 maintain good contact with one another.

In the above matching structure of the terminals 1 and 2, during the frictional Engagement of the terminals, metal oxide, dust, and dirt at the contact surfaces of the terminals is removed such that the terminals are self-cleaning. Thus the terminals maintain a good contact state so as to have the preferred conduction and communication states for a longer time.

In the above mentioned embodiment, it is preferred that the rigidity strength of the passive terminal 2 is greater than that of the active terminal 1 so that the elasticity of the active terminal is greater than that of the passive terminal 2. Thereby when the active terminal 1 is pressed into contact with the passive terminal 2, a dramatic friction force is induced so as to have the effect of removing undesired objects on the contact surfaces and thus having the function of self-cleaning.

According to FIG. 1, the position for matching the active terminal 1 to the passive terminal 2 is placed on the inclined surface 11*a* of a rear side of the active terminal 1. According to FIG. 2, the position for matching the active terminal 1 to the passive terminal 2 is placed on the inclined surface 11*b* of the front of the active terminal 1. The position for matching the terminal is dependent on the form and kind of each terminal and is not limited.

Figure 3:
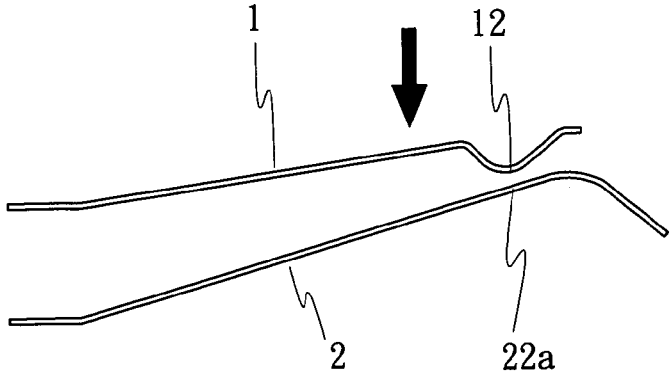
FIG. 3 is a perspective view showing that the active terminal contacts the passive terminal by compressing the passive terminal in the same direction at the top rear surface of the passive terminal of this embodiment.
Figure 4:
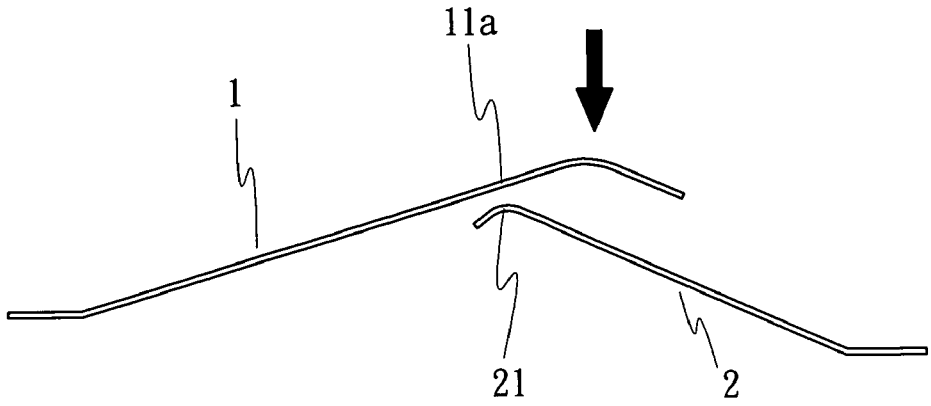
FIG. 4 is a perspective view showing that the active terminal contacts the passive terminal by compressing the passive terminal in a different direction at the bottom rear surface of the active terminal of this embodiment.
Figure 5:
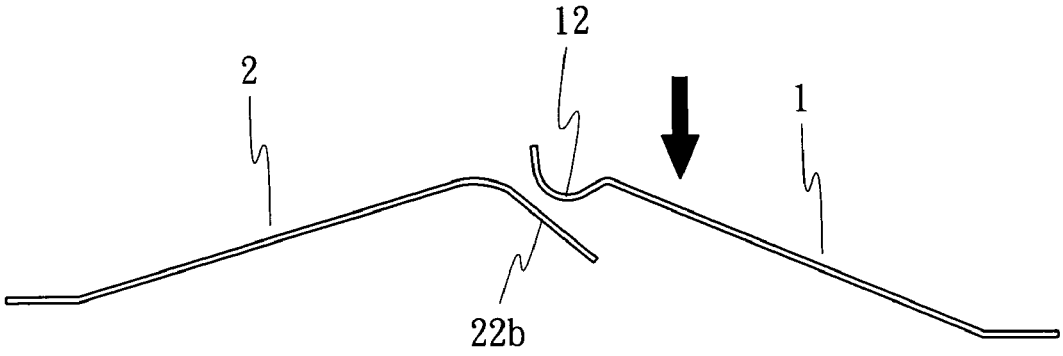
FIG. 5 is a perspective view showing that the active terminal contacts the passive terminal by compressing the passive terminal in a different direction at the top front surface of the passive terminal of this embodiment.
Figure 6:
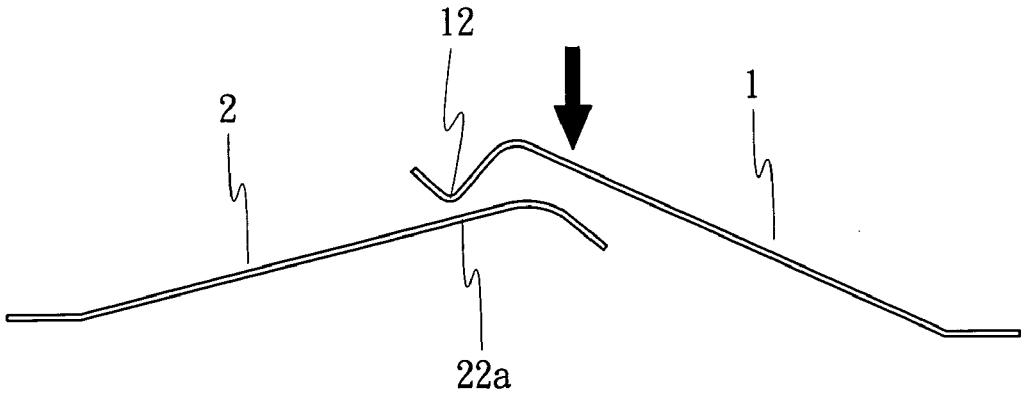
FIG. 6 is a perspective view showing that the active terminal contacts the passive terminal by compressing the passive terminal in a different direction at the top rear surface of the passive terminal of this embodiment.
Figure 7:
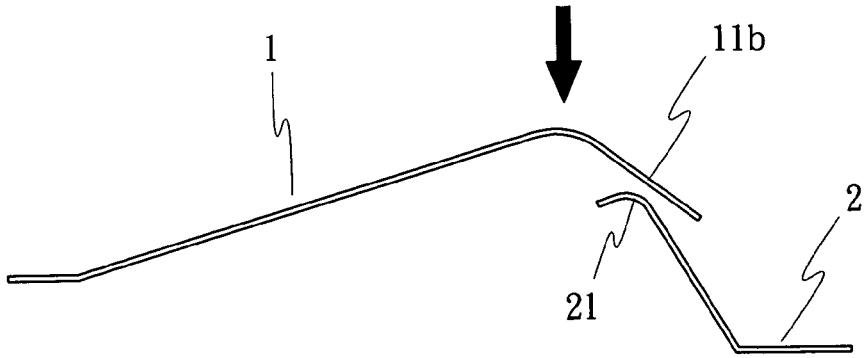
FIG. 7 is a perspective view showing that the active terminal contacts the passive terminal by compressing the passive terminal in a different direction at the bottom front surface of the active terminal of this embodiment.

Referring to FIG. 3, the terminal matching assembly has a cambered arc 12 on the matching portion of the active terminal 1. The matching portion of the corresponding position of the passive terminal 2 has an inclined surface 22*a*. Thereby when the active terminal 1 and the passive terminal 2 are compressed downwards, the cambered arc 12 and the inclined surface 22*a* are rubbed against one another so as to have the function of self-cleaning.

The active terminal 1 and the passive terminal 2 of the terminal matching assembly are compressed downwards in the same direction to combine with each other. Or referring to FIGS. 4, 5, 6 and 7, as these embodiments illustrate, the active terminal 1 and the passive terminal 2 are compressed downwards from different directions to combine with each other. The matching inclined surface 11*a* (11*b*) or 22*a* (22*b*) and cambered arc 12 or 21 are provided to have the function of self-cleaning by friction between them.

Figure 8:
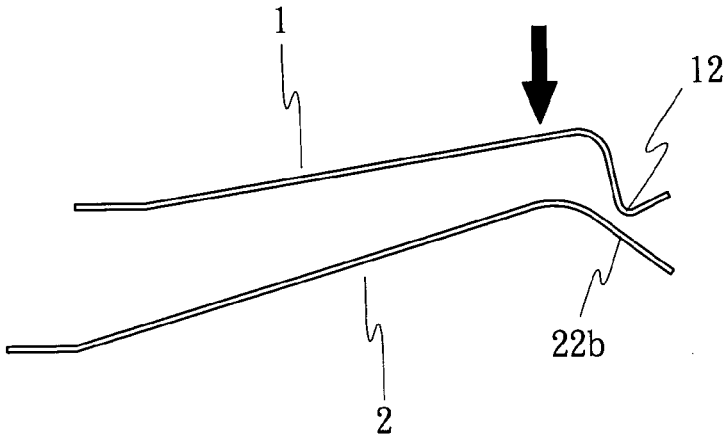
FIG. 8 is a perspective view showing that the active terminal contacts the passive terminal by compressing the passive terminal in the same direction at the top front surface of the passive terminal of this embodiment.

Referring to FIG. 8, the structure of the embodiment is similar to those illustrated in the FIG. 3. The major difference is that the position for matching the active terminal 1 to the passive terminal 2 is placed on the front inclined surface 22*b*.

Figure 9:
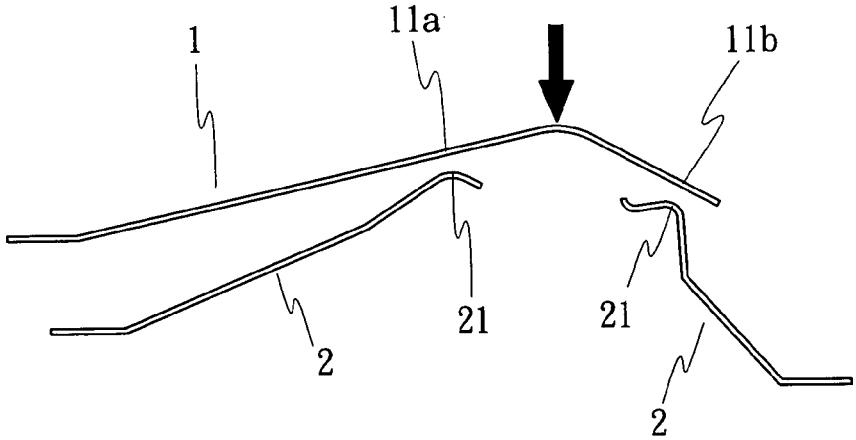
FIG. 9 is a perspective view showing that two inclined surfaces of the one single active terminal are in contact with one another by pressing the two passive terminals in another embodiment.
Figure 10:
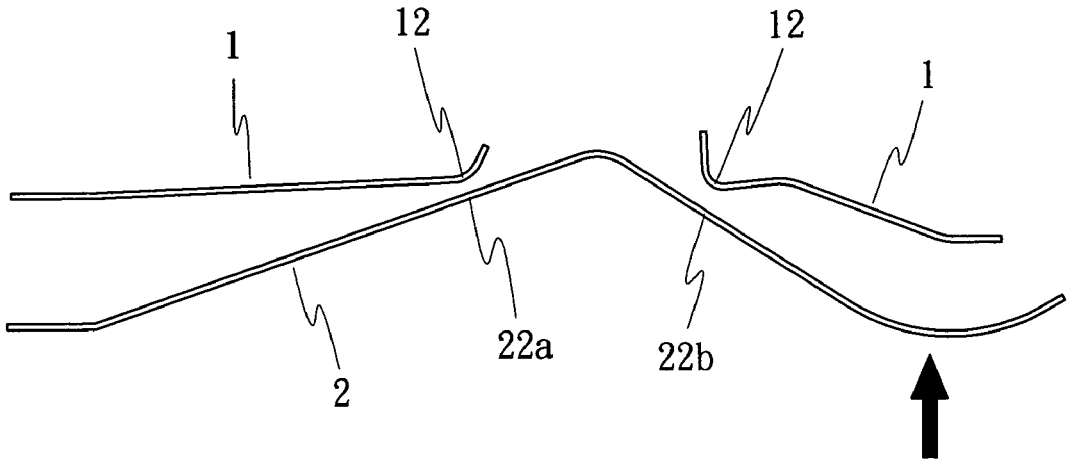
FIG. 10 is a perspective view showing that two active terminals are in contact with one another by pressing one single passive terminal.
Figure 11:
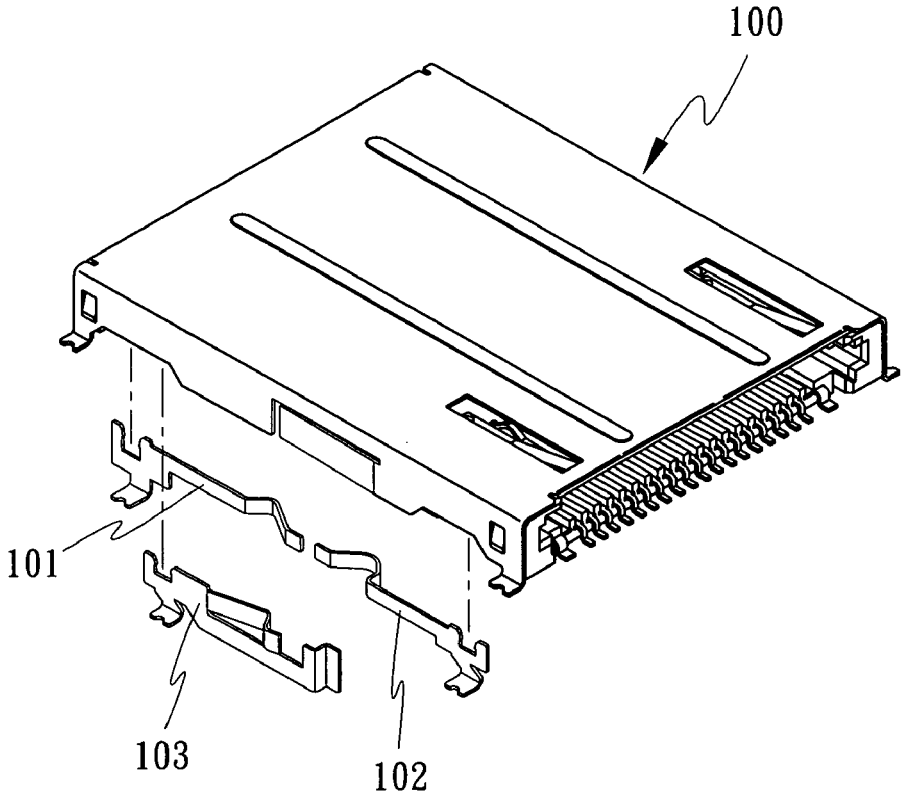
FIG. 11 is an exploded perspective view showing an embodiment that is applied to the detection terminals of a card reader.
Figure 12:
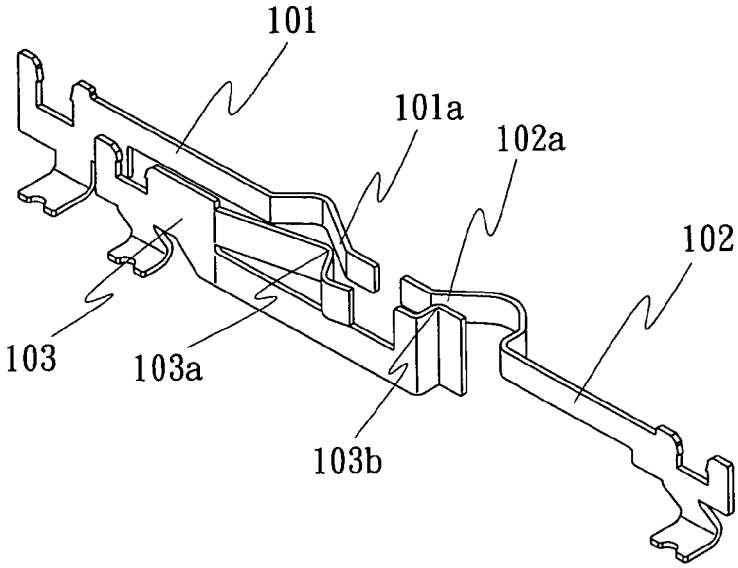
FIG. 12 is a perspective view showing the detection terminals of the embodiment of FIG. 11.
Figure 13:
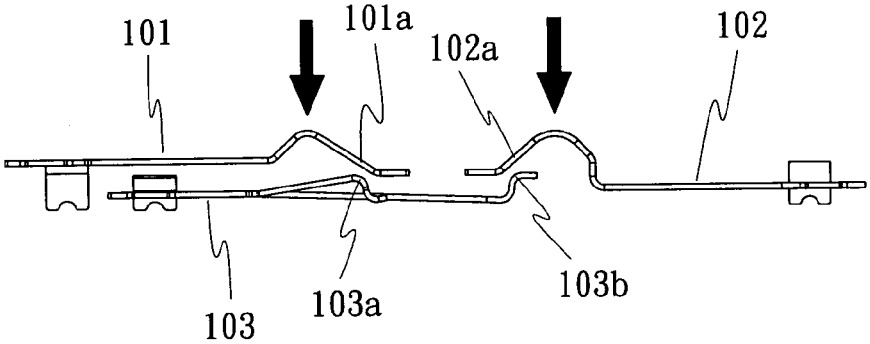
FIG. 13 is a perspective view showing the state of the detection terminals of the embodiment of FIG. 12 before the detection terminals are in contact with one another.
Figure 14:
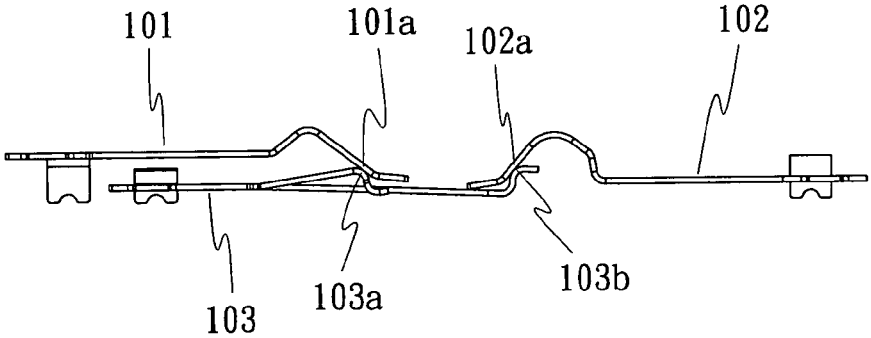
FIG. 14 is a perspective view showing the state of the detection terminals of the embodiment of FIG. 12 after the detection terminals are in contact with one another.
Figure 15:
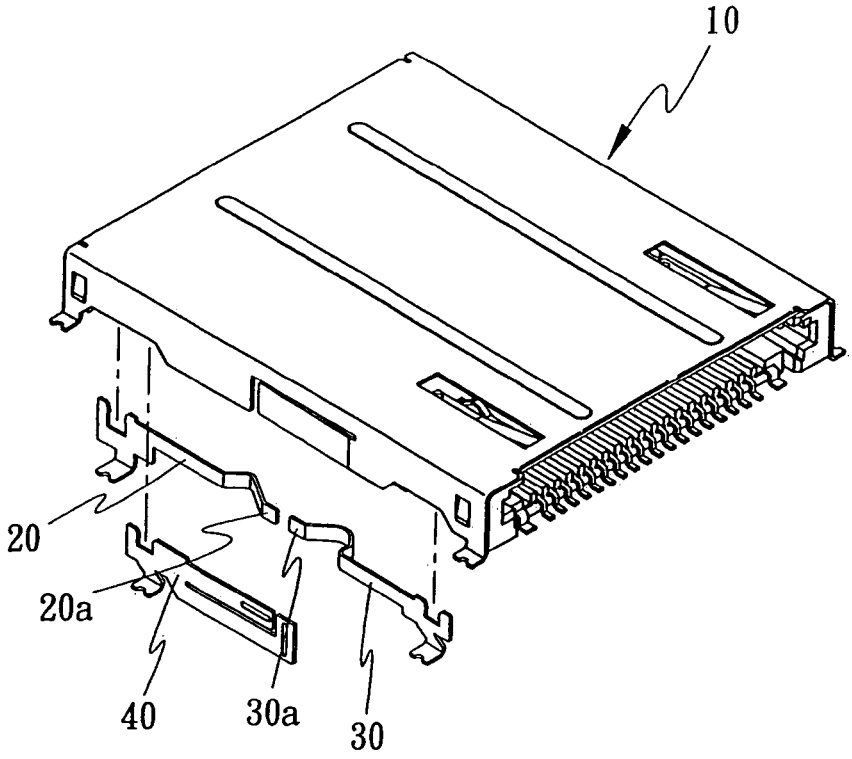
Prior Art FIG. 15
FIG. 15 is a perspective view showing a prior art card reader and the detection terminals.
Figure 16:
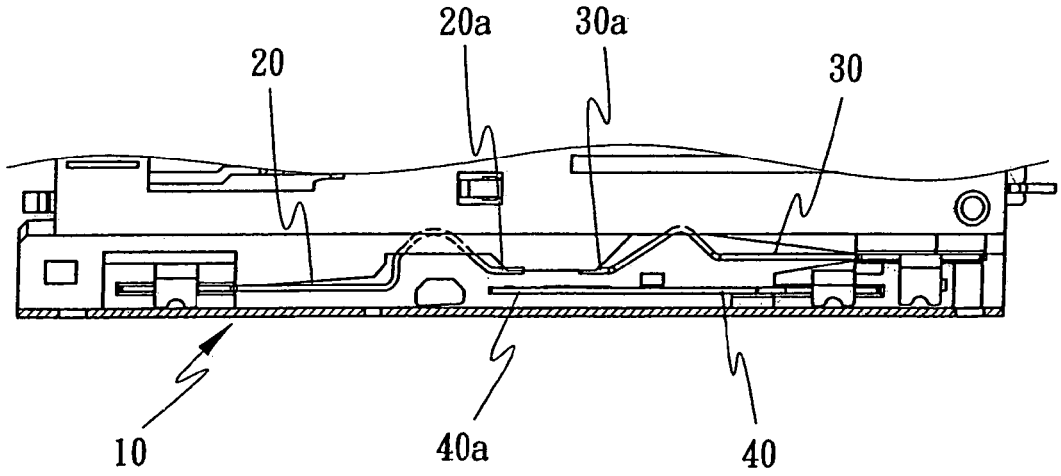
Prior Art FIG. 16
FIG. 16 is a perspective view showing the state of the prior art card reader before a memory card is inserted into the card reader to press the detection terminals into contact.

FIG. 9 illustrates the structure of another assembly terminal. The assembly has a Single active terminal 1 and two passive terminals 2. The rear inclined surface 11*a* and the front inclined surface 11*b* of the active terminal 1 are available to compress downwards to connect with the cambered arcs 21 of the two passive terminals. Thereby the two sides of the inclined surface 11*a* and 11*b* are able to self-clean during the frictional engagement of the terminals. FIG. 10 illustrates a similar structure as mentioned above. The assembly terminal has two active terminals 1 and a single passive terminal 2. The two sides of the inclined surface 22*a* and 22*b* of the passive terminal 2 are available to contact the cambered arcs 12 of the two active terminals 1 so as to have the function of self-cleaning.

FIGS. 11 to 14 illustrate the various detection terminal sheets 101, 102 and 103 of the embodiments. The detection terminal sheets are used in a memory insertion seat 100 of a card reader. The detection terminal sheets 101 and 102 are the active terminals, and the other detection terminal sheet 103 is the passive terminal. When the memory card is inserted into the memory insertion seat, the detection terminal sheets 101 and 102 are pushed forwards so that the inclined surfaces 101*a* and 102*a* of the detection terminal sheets 101 and 102 (shown as FIG. 13) are compressed downwards to contact the cambered arcs 103*a* and 103*b* of the detection terminal sheet 103 correspondingly (shown as FIG. 14). The cambered arcs 103*a* and 103*b* are compressed downwards to connect with the inclined surfaces 101*a* and 102*a* so as to have the function of self-cleaning during the frictional engagement of the terminals. Therefore during the frictional engagement, metal oxide, dust, and dirt at the contact surfaces of the terminals can be removed so as to have the effect of self-cleaning.

In the above mentioned embodiment, it is preferred that the rigidity strength of the detection terminal sheet 103 of the passive contact is greater than that of the detection terminal sheets 101 and 102 of the active contact so that the elasticity of the detection terminal sheets 101 and 102 of the active contact is greater than that of the detection terminal sheet 103 of the passive contact. Thereby when the detection terminal sheets 101 and 102 of the active contact are pressed to contact the detection terminal sheet 103 of the passive contact, a dramatic friction force is induced so as to have the effect of removing undesired objects on the contact surfaces and thus having the function of self-cleaning.

The present embodiments are thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A self cleaning terminal matching assembly comprising:

one active terminal having a rear inclined surface and a front inclined surface; and two passive terminals each having inclined surfaces having a configuration corresponding to the inclined surfaces of the active terminal, wherein the inclined surfaces of the passive terminals are cambered arcs;

wherein the rear inclined surface and the front inclined surface of the active terminal are available to compress downwards to contact the inclined surfaces of the two passive terminals;

whereby, due to friction between the active terminal and the passive terminals, the terminal assembly has the function of self-cleaning.

2. The self-cleaning terminal matching assembly as claimed in claim 1, wherein the rigidity strength of the passive terminals is greater than that of the active terminal so that the elasticity of the active terminal is greater than that of the passive terminals.

3. The self-cleaning terminal matching assembly as claimed in claim 1, wherein during assembly, the active terminal and the passive terminals are compressed downwards in the same direction.

4. The self-cleaning terminal matching assembly as claimed in claim 1, wherein the active terminal and one of the passive terminals are compressed downwards in a different direction.

5. A self cleaning terminal matching assembly comprising:

two active terminals each having an inclined surface; and a passive terminal having inclined surfaces having a configuration corresponding to the inclined surfaces of the active terminals, wherein the inclined surfaces of the passive terminal are cambered arcs;

wherein the inclined surfaces of the active terminals are available to compress downwards to contact the inclined surfaces of the passive terminal;

whereby, due to friction between the active terminals and the passive terminal, the terminal assembly has the function of self-cleaning.

6. The self-cleaning terminal matching assembly as claimed in claim 5, wherein the rigidity strength of the passive terminal is greater than that of the active terminals so that the elasticity of the active terminals is greater than that of the passive terminal.

7. The self-cleaning terminal matching assembly as claimed in claim 5, wherein the inclined surfaces of the active terminals are cambered protruding surfaces and the inclined surfaces of the passive terminal are corresponding to that of the active terminal.

8. The self-cleaning terminal matching assembly as claimed in claim 5, wherein at least one of the active terminals and the passive terminal are compressed downwards in a different direction.

* * * * *